US007992959B2

(12) United States Patent
Edwards et al.

(10) Patent No.: US 7,992,959 B2
(45) Date of Patent: Aug. 9, 2011

(54) PRINTING SYSTEM WITH TRANSIENT AND PERMANENT IMAGING MEANS

(75) Inventors: Mark Joseph Edwards, Lexington, KY (US); John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1043 days.

(21) Appl. No.: 11/830,154

(22) Filed: Jul. 30, 2007

(65) Prior Publication Data

US 2009/0034997 A1 Feb. 5, 2009

(51) Int. Cl.
*B41J 2/015* (2006.01)
*B41J 2/14* (2006.01)
*B41J 2/17* (2006.01)

(52) U.S. Cl. ..... 347/21; 347/51; 347/95

(58) Field of Classification Search ..... 347/20
See application file for complete search history.

(56) References Cited

U.S. PATENT DOCUMENTS

| | | | | |
|---|---|---|---|---|
| 2005/0141906 | A1 | 6/2005 | Murakami | |
| 2005/0244742 | A1 | 11/2005 | Iftime et al. | |
| 2005/0244743 | A1 | 11/2005 | Iftime et al. | |
| 2005/0244744 | A1 | 11/2005 | Kazmaier et al. | |
| 2005/0287475 | A1 | 12/2005 | Iftime et al. | |
| 2006/0164444 | A1 * | 7/2006 | Ferguson et al. | 347/2 |
| 2006/0222972 | A1 | 10/2006 | Chopra et al. | |
| 2006/0251988 | A1 | 11/2006 | Iftime et al. | |
| 2006/0269878 | A1 | 11/2006 | Chopra et al. | |
| 2006/0286481 | A1 | 12/2006 | Iftime et al. | |
| 2007/0003847 | A1 | 1/2007 | Chopra et al. | |
| 2008/0191136 | A1 * | 8/2008 | Shrader et al. | 250/316.1 |

* cited by examiner

*Primary Examiner* — Matthew Luu
*Assistant Examiner* — Kendrick X Liu
(74) *Attorney, Agent, or Firm* — John Victor Pezdek; Justin M. Tromp

(57) ABSTRACT

A printing system including a substrate and a dual-mode printing device, the dual-mode printing device including a permanent writing source and a transient writing source, wherein the permanent writing source is adapted to deposit an imaging material onto the substrate and the transient writing source is adapted to develop an image on the substrate by applying a stimulus to the substrate.

12 Claims, 3 Drawing Sheets

PRINTING SYSTEM WITH TRANSIENT AND PERMANENT IMAGING MEANS

TECHNICAL FIELD

The present application is directed to printers and, more particularly, to printing systems capable of generating both a transient image on a substrate and a permanent image on a substrate.

BACKGROUND

Printers, whether embodied on a peripheral printing device, a stand-alone printing device, a facsimile machine or an all-in-one or multi-functional device, have become commonplace in the home and office. As a result, paper consumption has increased significantly. Furthermore, a significant portion of printed paper finds its way into the paper recycling system. Indeed, it has been suggested that as much as 21 percent of printed (black and white) documents make their way into the recycling system the same day they are printed.

Reimageable, self-erasing paper ("erasable paper") was developed in an effort to curb paper consumption by printers. One example of erasable paper is paper that incorporates embedded photochromic particles within the paper. The photochromic particles may be activated to an imaged state upon exposure to light of a certain predetermined wavelength. The imaged photochromic particles fade back to their un-imaged state in an ambient environment after a certain amount of time (e.g., after 16 hours). Photochromic-based erasable paper is described in greater detail in U.S. Patent Pub. No. 2005/0287475 published on Dec. 29, 2005 (U.S. Ser. No. 11/215,950 filed on Aug. 30, 2005).

However, in certain circumstances, there still remains a need for printing permanent documents. For example, while many documents may be stored in electronic format (e.g., as PDF files on a storage medium) and may be printed, reviewed briefly, then discarded, certain documents, such as wills, must remain in their original, physical form. Therefore, such documents cannot be printed using a transient imaging means.

Accordingly, there is a need for a system and method for printing documents using both a transient imaging means and a permanent imaging means, as desired.

SUMMARY

In one aspect, the disclosed printing system may include a substrate and a dual-mode printing device, the dual-mode printing device including a permanent writing source and a transient writing source, wherein the permanent writing source is adapted to deposit an imaging material onto the substrate and the transient writing source is adapted to develop an image on the substrate by applying a stimulus to the substrate.

In another aspect, the disclosed dual-mode printing device may include a housing, a permanent writing source connected to the housing, the permanent writing source including an imaging material, and a transient writing source connected to the housing, the transient writing source including a light generating device adapted to selectively communicate light to a substrate.

In another aspect, the disclosed printing system may include an erasable substrate including a photochromic material and a dual-mode printing device, the dual-mode printing device including a printhead and an ultraviolet light source, wherein the printhead is adapted to deposit an ink or toner onto the erasable substrate and the ultraviolet light source is adapted to activate the photochromic material in the erasable substrate.

Other aspects of the disclosed printing system with transient and permanent imaging means will become apparent from the following description, the accompanying drawings and the appended claims.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
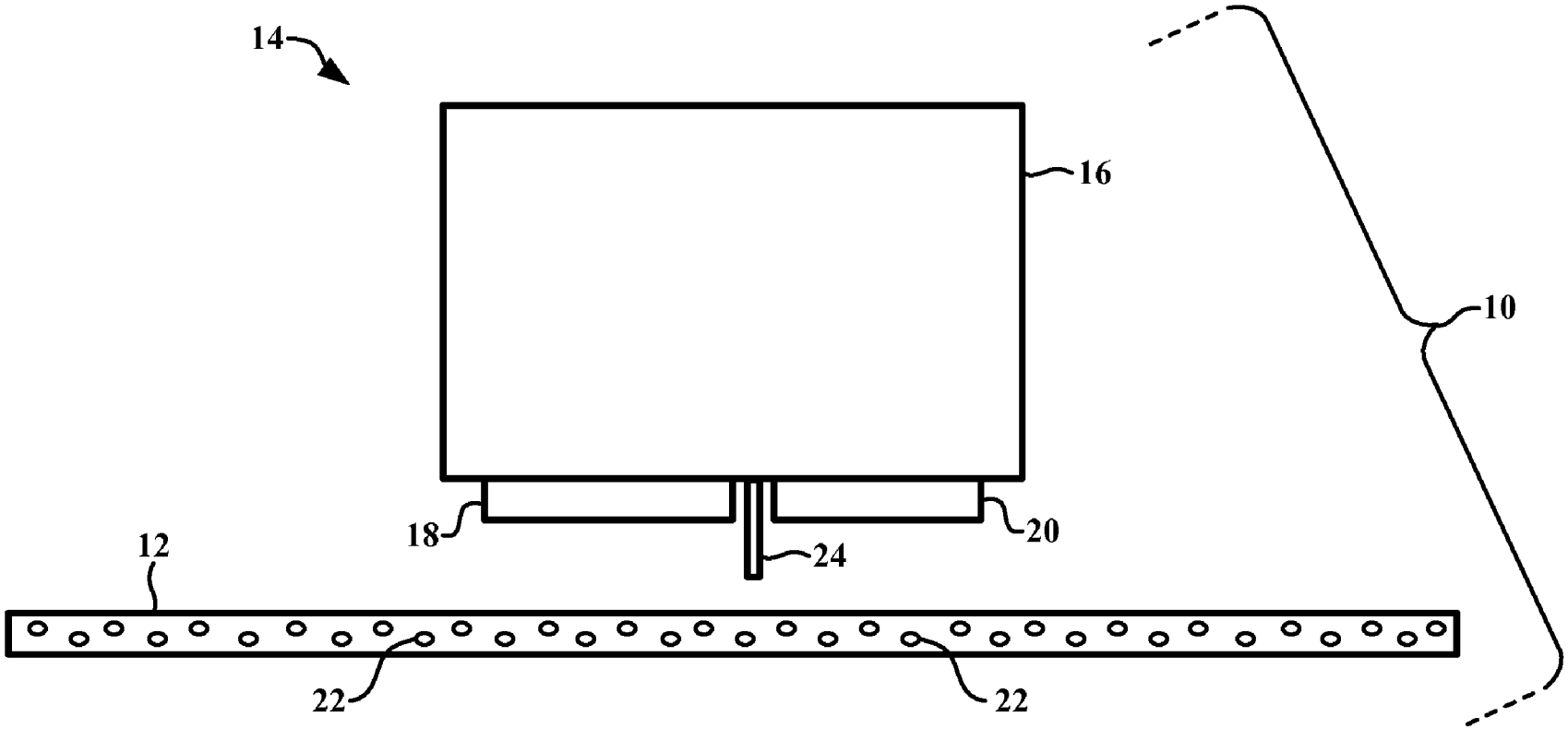
FIG. 1 is a front elevational view of one aspect of the disclosed printing system.

Referring to FIG. 1, one aspect of the disclosed printing system, generally designated 10, may include a substrate 12, such as an erasable substrate, and a dual-mode printing device 14. The dual-mode printing device 14 may be embodied on a printer (not shown), such as a peripheral printer, a stand-alone printer, a facsimile machine or an all-in-one device, and may include a carriage or housing 16, a permanent writing source 18 and a transient writing source 20.

Optionally, a shield 24 or the like may be positioned between the permanent writing source 18 and the transient writing source 20 to reduce accumulation of imaging material (e.g., ink/toner mist) from the permanent writing source 18 on the transient writing source 20. Furthermore, a cleaning device, such as a wiper (not shown) may be used to remove imaging material (e.g., ink/toner mist) deposited on the transient writing source 20.

The erasable substrate 12 may be any substrate capable of forming an image, or otherwise capable of being marked, in response to a stimulus supplied by the transient writing source 20, wherein the image or marking disappears or fades, whether over time or substantially instantly, or is otherwise erasable (e.g., upon application of an erasing agent, such as heat, light or a chemical agent, to the erasable substrate 12). In one aspect, the stimulus may be energy in the form of light (e.g., ultraviolet light) or heat.

The erasable substrate 12 may be formed as a generally flat sheet capable of passing through a printing device. However, those skilled in the art will appreciate that various forms and configurations of the erasable substrate 12 may be used without departing from the scope of the present disclosure. Furthermore, the erasable substrate 12 may be formed from any material or combination of materials capable of being marked by both the permanent writing source 18 and the transient writing source 20. For example, the erasable substrate 12 may be a paper or cellulose-based material, a polymer-based material, cloth or the like.

In one aspect, the erasable substrate 12 may include a photochromic or thermochromic material. The photochromic or thermochromic material may be dispersed throughout the erasable substrate 12, layered over the erasable substrate 12 or otherwise associated with the erasable substrate 12. For example, as shown in FIG. 1, the erasable substrate 12 may include a plurality of photochromic or thermochromic particles 22 dispersed therethrough. The photochromic or thermochromic material may be rendered visible on the erasable substrate 12 (i.e., activated to an imaged or imaging state) upon exposure to the stimulus (e.g., light for photochromic materials or heat for thermochromic materials) supplied by the transient writing source 20.

Examples of substrates and materials useful in or as the erasable substrate 12 of the present disclosed are described in greater detail in U.S. Patent Pub. No. 2005/0244742 published on Nov. 3, 2005 (U.S. Ser. No. 10/834,529 filed on Apr. 29, 2004), the entire contents of which are incorporated herein by reference, U.S. Patent Pub. No. 2005/0244743 published on Nov. 3, 2005 (U.S. Ser. No. 10/834,722 filed on Apr. 29, 2004), the entire contents of which are incorporated herein by reference, U.S. Patent Pub. No. 2005/0244744 published on Nov. 3, 2005 (U.S. Ser. No. 10/835,518 filed on Apr. 29, 2004), the entire contents of which are incorporated herein by reference, U.S. Patent Pub. No. 2005/0287475 published on Dec. 29, 2005 (U.S. Ser. No. 11/215,950 filed on Aug. 30, 2005), the entire contents of which are incorporated herein by reference, U.S. Patent Pub. No. 2006/0222972 published on Oct. 5, 2006 (U.S. Ser. No. 11/093,965 filed on Mar. 30, 2005), the entire contents of which are incorporated herein by reference, U.S. Patent Pub. No. 2006/0251988 published on Nov. 9, 2006 (U.S. Ser. No. 11/123,163 filed on May 6, 2005), the entire contents of which are incorporated herein by reference, U.S. Patent Pub. No. 2006/0269878 published on Nov. 30, 2006 (U.S. Ser. No. 11/139,890 filed on May 27, 2005), the entire contents of which are incorporated herein by reference, U.S. Patent Pub. No. 2006/0286481 published on Dec. 21, 2006 (U.S. Ser. No. 11/146,706 filed on Jun. 7, 2005), the entire contents of which are incorporated herein by reference, and U.S. Patent Pub. No. 2007/0003847 published on Jan. 4, 2007 (U.S. Ser. No. 11/156,437 filed on Jun. 20, 2005), the entire contents of which are incorporated herein by reference. However, those skilled in the art will appreciate that various other substrates and materials may be useful in or as the erasable substrate 12.

The permanent writing source 18 may be any device capable of physically depositing an imaging material, such as ink or toner, onto the erasable substrate 12. For example, the permanent writing source 18 may be an ink-jet printhead. However, those skilled in the art will appreciate that the permanent writing source 18 may perform laser printing, dye-sublimation printing or any other permanent printing technique, and is not limited to ink-jet applications.

Furthermore, the word "permanent" in "permanent writing source 18" simply refers to the function of creating an image or marking by depositing an imaging material from the permanent writing source 18 onto the erasable substrate 12, rather than developing an image on the erasable substrate 12 based upon imaging materials pre-existing on the erasable substrate 12. Therefore, those skilled in the art will appreciate that the imaging material deposited by the permanent writing source 18 need not necessarily be "permanent" as the word is used in connection with, for example, permanent markers (e.g., SHARPIE® markers), but rather may be temporary, erasable, dissolvable, wipeable or otherwise removable from the erasable substrate 12. The imaging material deposited by the permanent writing source 18 may be any imaging material, including any available ink or toner, and is not limited to imaging materials that are generally "permanent" in nature.

The transient writing source 20 may be any device capable of communicating a stimulus to the erasable substrate 12 to develop or otherwise form an image on the erasable substrate 12. The type of stimulus supplied by the transient writing source 20 will depend upon the type of erasable substrate 12 being used. In one example, when the erasable substrate 12 includes photochromic materials, the transient writing source 20 may communicate light (e.g., ultraviolet light) to the erasable substrate 12 to selectively develop or image the photochromic materials and create an image or marking on the erasable substrate 12. In another example, when the erasable substrate 12 includes thermochromic materials, the transient writing source 20 may communicate heat (e.g., by a laser or heating elements) to the erasable substrate 12 to selectively develop or image the thermochromic materials and create an image or marking on the erasable substrate 12.

In one aspect, the transient writing source 20 may consist of or may include a suitably focused light emitting diode ("LED"), such as an ultraviolet LED. In another aspect, the transient writing source 20 may consist of or may include an array, matrix, column or row of LEDs, such as ultraviolet LEDs.

The permanent writing source 18 and the transient writing source 20 may be positioned in or otherwise connected to the housing 16 in various configurations, depending upon the operation and configuration of the system 10. The housing 16 may be moveable relative to the erasable substrate 12 such that the permanent writing source 18 and the transient writing source 20 are capable of forming images or markings at various locations on the erasable substrate 12.

In one particular example, the housing 16 may be or may include an ink-jet printhead carriage, the permanent writing source 18 may be or may include an ink-jet printhead and the transient writing source 20 may be or may include one or more ultraviolet LEDs.

In a second particular example, the transient writing source 20 may be positioned in or connected to an inkjet printhead carriage. Specifically, the transient writing source 20 may be positioned on the inkjet printhead carriage at a location where an auto-alignment sensor is typically located.

Thus, by moving the housing 16 relative to the erasable substrate 12, the system 10 may form an image on the erasable substrate 12 by (1) actuating the transient writing source 20 to provide a stimulus to the erasable substrate 12 such that an image or marking is developed on the erasable substrate 12 (i.e., the erasable substrate is imaged) and/or (2) actuating the permanent writing source 18 such that the permanent writing source deposits an imaging material onto the erasable substrate 12.

Figure 2:
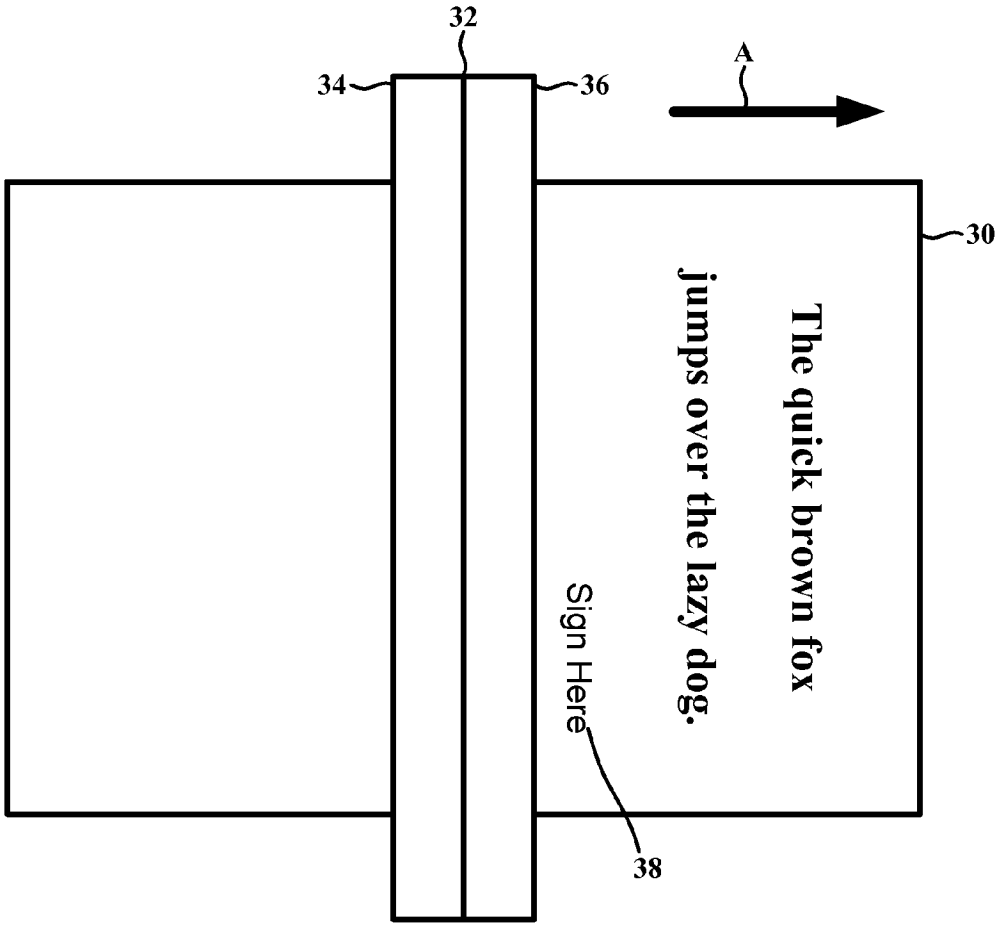
FIG. 2 is a top plan view of a page-wide array imaging system embodying the printing system of FIG. 1.
Figure 3:
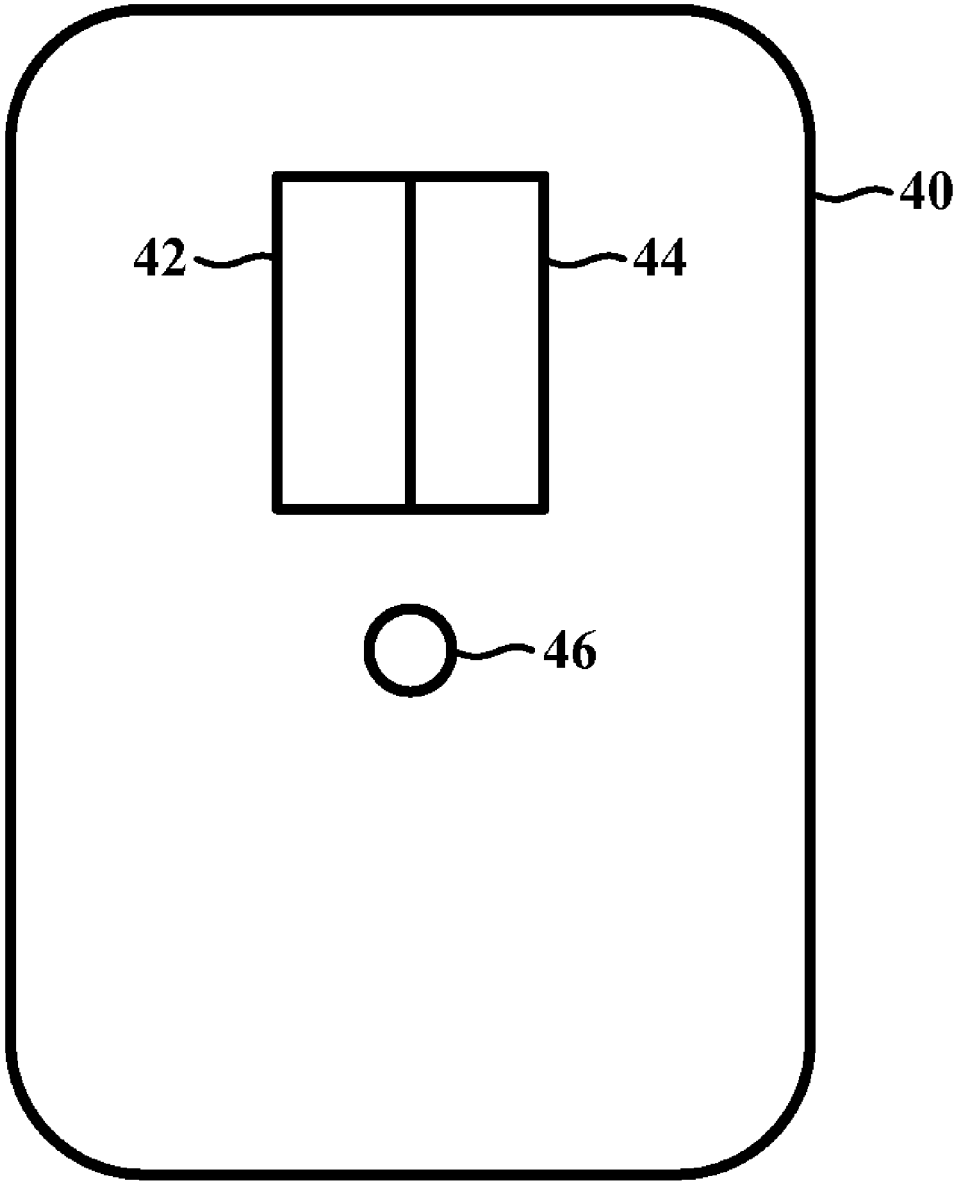
FIG. 3 is a bottom view of a hand-held imaging system embodying the printing system of FIG. 1.

While the use of both a permanent and transient writing source 18, 20 is described generally (FIG. 1), those skilled in the art will appreciate that specific applications include the use of a page-wide array imaging system, as shown in FIG. 2, and a hand-held imaging system, as shown in FIG. 3.

Referring to FIG. 2, an erasable substrate 30 may be imaged by a dual-mode page-wide device 32. The dual-mode page-wide device 32 may include a transient writing source 34 (e.g., an array of LEDs) and a permanent writing source 36 (e.g., an array of ink-jet printheads). Optionally, as shown in FIG. 2, the erasable substrate 30 may move in the direction shown by arrow A (i.e., from a proximal location to a distal location) and the transient writing source 34 may be positioned in a proximal position (i.e., to the left in FIG. 2) relative to the permanent writing source 36 such that the deposition of imaging material by the permanent writing source 36 does not interfere with the transient imaging by the transient writing source 34 (e.g., toner or ink may block light from imaging photochromic materials in the erasable substrate 30).

Referring to FIG. 3, an erasable substrate (not shown) may be imaged by a hand-held device 40 that includes a transient writing source 42 and a permanent writing source 44. An optical position sensor 46 may guide the permanent 44 and transient 42 writing sources relative to the erasable substrate.

Thus, the disclosed system 10 provides the ability to print documents (including text and images) by (1) depositing imaging material onto an erasable substrate 12 with the permanent writing source 18 and/or (2) developing a transient image on the erasable substrate by applying a stimulus (e.g., light or heat) to the erasable substrate 12 with the transient writing source 20. Various examples of applications of the disclosed system 10 are discussed below.

In a first example application, the disclosed system 10 may be used to print a manual duplex arrow that directs proper reload of the print job into the feed tray. Typically, such pages are wasted as no portion of the print job is printed on the page with the arrow. However, using the disclosed system 10, the arrow may be integrally printed with the system's transient printing means on the last odd page of the print job, preferably in the top margin (nearest the user in the exit tray) and in a color that allows it to be readily noticed and in an orientation that allows it to be easily read. The arrow and directions line, being printed with the transient writing source 20, eventually disappear.

In a second example application, the disclosed system 10 may be used to print letter fold marks with the transient writing source 20 and the text of a letter with the permanent writing source 18.

In a third example application, the disclosed system 10 may be used to print job separation marks. For example, if a user is printing 6 collated copies of a 10 page document (and then plans to staple each copy) with a standard printer, all of the 60 pages will stack together, in the order (top to bottom) copy 1 page 1-10, copy 2 page 1-10 . . . copy 6 page 1-10. While individual copies are correctly ordered, the user must still fan through the output page by page to separate the 6 copies. Retrieving and stapling the 6 copies take 5 searches, 5 separating steps, 6 squaring steps and 6 stapling steps. To simplify separating the jobs, an edge mark may be formatted and printed on the last page of every job with the system's transient writing source 20. Again, a selection might be provided in the printer driver for the user to set whether job separation marks are to be included or not. This may reduce the effort in finding the job divisions in the stack (eliminating 5 searches) with the additional benefit of no cost incurred for a separator sheet.

In a fourth example application, the disclosed system 10 may be used to print "Sign Here" tabs (See FIG. 2). Typically, when a document needs to be signed, a "sign here" temporary sticker is often used. The system 10 may print "sign here" markings using the transient writing source 20 that will eventually disappear and not obstruct the final document.

In a fifth example application, the disclosed system 10 may be used to print temporary alignment marks.

In a sixth example application, the disclosed system 10 may be used to print information intended to be revealed over time. In particular, text and images printed with system's permanent writing source 18 may be temporarily obscured by overprinting the same area with the transient writing source such that the text and images printed with the permanent writing source 18 are difficult if not impossible to read until the transient image fades. Such a feature could provide some level of security for documents containing sensitive information. This feature could also be applied to puzzles and games where the solution is initially obscured but revealed over time.

In a seventh example application, the disclosed system 10 may be used to improve a facsimile receiving system. Most fax machines used in the home or in small businesses are employed to receive legitimate faxes from a small number of known phone numbers. An improved fax machine might be provided that allows a user to set printing of received faxes to use either the permanent or transient printing means. Or, it might allow the user to assign faxes from legitimate numbers (from which faxes are expected) to be printed with permanent ink. It might allow the user to assign known spam-provider phone numbers so that the page is received and discarded, i.e. for these numbers printing is blocked. It might allow faxes from any other numbers to be assigned to print with the system's transient printing means, if desired.

In an eighth example application, the disclosed system 10 may be used to improve the functionality of a hand held printer device. Specifically, when printing with the hand held printer device, yet-to-be printed areas may be made more easily identifiable by printing one or more of a suitable background and a bounding box with the transient writing source 42 (FIG. 3). Gaps and non-uniformity in the transient printing output would give the user intuitive feedback that there are regions yet to be printed with the device.

Although various aspects of the disclosed printing system with transient and permanent imaging means have been shown and described, modifications may occur to those skilled in the art upon reading the specification. The present application includes such modifications and is limited only by the scope of the claims.

What is claimed is:

1. A dual-mode printing device comprising:

a housing;

a permanent writing source connected to said housing, said permanent writing source including an imaging material; and a transient writing source connected to said housing next to said permanent writing source, said transient writing source including a light generating device for selectively communicating light to a substrate.

2. The dual-mode printing device of claim 1 wherein said housing includes an ink-jet printhead cartridge.

3. The dual-mode printing device of claim 1 wherein said permanent writing source includes an ink-jet printhead.

4. The dual-mode printing device of claim 1 wherein said imaging material is ink or toner.

5. The dual-mode printing device of claim 1 wherein said light generating device includes a light emitting diode.

6. The dual-mode printing device of claim 5 wherein said light emitting diode is an ultraviolet light emitting diode.

7. The dual-mode printing device of claim 1, further comprising a shield positioned between said permanent writing source and said transient writing source.

8. The dual-mode printing device of claim 1, further comprising a cleaning device positioned to remove said imaging material from said permanent writing source deposited on said transient writing source.

9. The dual-mode printing device of claim 1, wherein said permanent writing source and said transient writing source are supported by a common support member connected to said housing.

10. The dual-mode printing device of claim 9, wherein said common support member is a movable printhead carriage.

11. The dual-mode printing device of claim 1, wherein said permanent writing source and said transient writing source are fixedly mounted in a page-wide array.

12. The dual-mode printing device of claim 11, wherein said permanent writing source is positioned downstream in a media process direction from said transient writing source.

* * * * *